US006365791B1

(12) United States Patent
Ambrosino et al.

(10) Patent No.: US 6,365,791 B1
(45) Date of Patent: Apr. 2, 2002

(54) PROCESS FOR CONVERTING HYDROCARBONS BY TREATMENT IN A DISTILLATION ZONE COMPRISING EXTRACTING A HYDROCARBON CUT AS A SIDE STREAM, ASSOCIATED WITH A REACTION ZONE, AND ITS USE FOR HYDROGENATING BENZENE

(75) Inventors: Jean-Louis Ambrosino, Ternay; Jean-Charles Viltard, Vienne; Blaise Didillon, Rueil-Malmaison, all of (FR)

(73) Assignee: Institut Francais du Petrole (FR)

( * ) Notice: Subject to any disclaimer, the term of this patent is extended or adjusted under 35 U.S.C. 154(b) by 0 days.

(21) Appl. No.: 09/376,054

(22) Filed: Aug. 17, 1999

(30) Foreign Application Priority Data

Aug. 17, 1998 (FR) ..... 98 10497

(51) Int. Cl.[7] ..... C07C 5/00

(52) U.S. Cl. ..... 585/263; 585/264; 585/266; 585/275

(58) Field of Search ..... 585/263, 250, 585/266, 275, 264

(56) References Cited

U.S. PATENT DOCUMENTS

| | | | | |
|---|---|---|---|---|
| 3,655,551 A | | 4/1972 | Hass et al. | 208/59 |
| 3,926,785 A | | 12/1975 | Siegel | 208/211 |
| 4,302,356 A | | 11/1981 | Smith, Jr. | 252/426 |
| 4,662,995 A | * | 5/1987 | Lipkin et al. | 203/98 |
| 5,073,236 A | | 12/1991 | Gelbein et al. | 203/29 |
| 5,302,356 A | | 4/1994 | Shadman et al. | 422/186.3 |
| 5,362,377 A | | 11/1994 | Marker | 208/133 |
| 5,817,227 A | | 10/1998 | Mikitenko et al. | 208/143 |
| 5,914,435 A | * | 6/1999 | Streicher et al. | 585/819 |

FOREIGN PATENT DOCUMENTS

| | | |
|---|---|---|
| EP | 0 781 830 | 7/1997 |

* cited by examiner

*Primary Examiner*—Bekir L. Yildirim
(74) *Attorney, Agent, or Firm*—Millen, White, Zelano & Branigan, P.C.

(57) ABSTRACT

The invention provides a process for converting hydrocarbons in which said feed is treated in a distillation zone associated with a reaction zone, the feed for the reaction zone being drawn off at the height of at least one draw-off level, the effluent from the reaction zone being re-introduced into the distillation zone at the height of a re-introduction level, said process being characterized in that a liquid effluent is also withdrawn from the distillation zone at the height of a withdrawal level, said liquid effluent being treated in a gas-liquid side separation zone (splitter), the gaseous effluent being re-introduced into the distillation zone and the liquid effluent being recovered as an intermediate cut. This process can be used to reduce the benzene content of a hydrocarbon cut and to recover a naphtha cut.

19 Claims, 1 Drawing Sheet

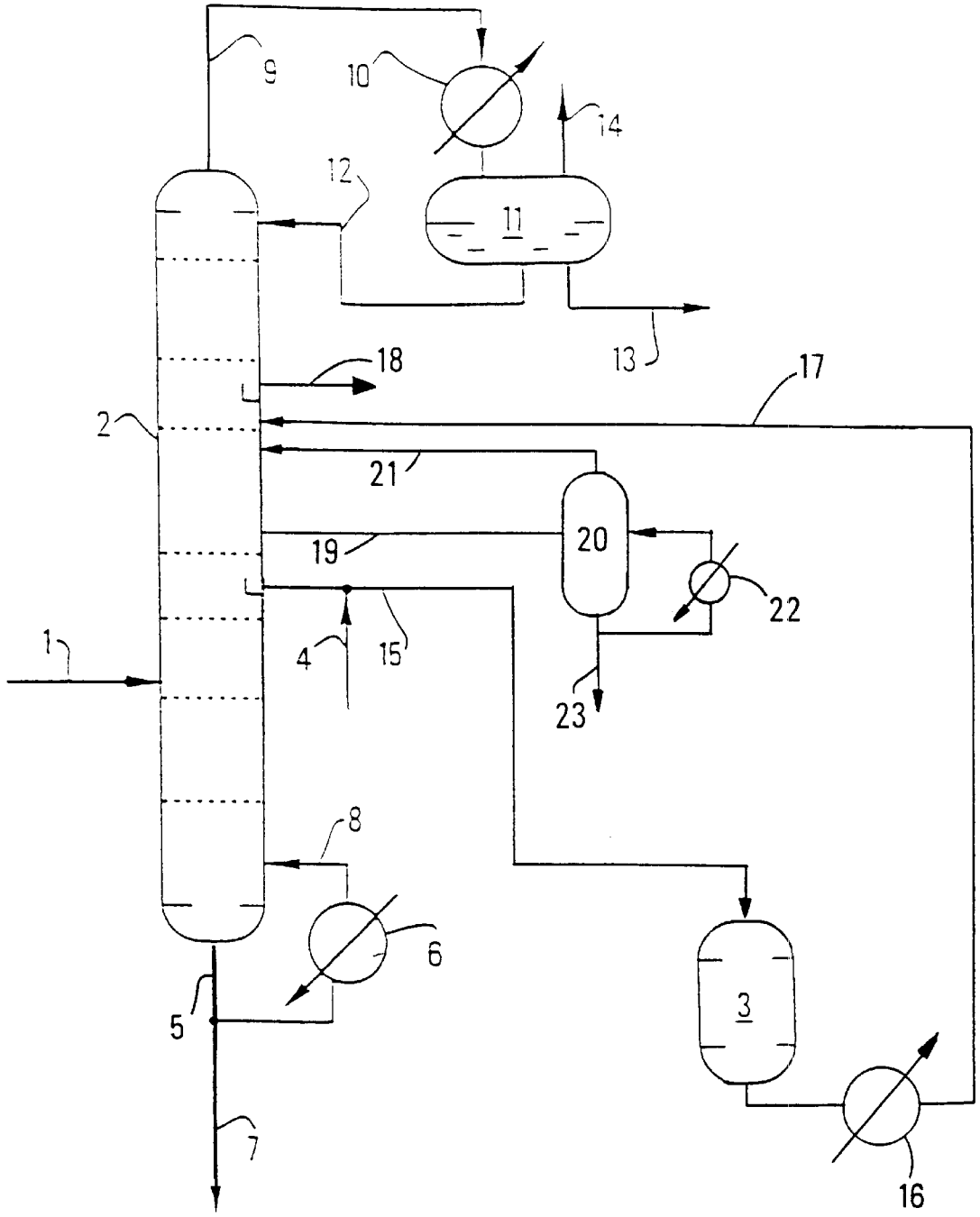
9
10
14
12
11
13
18
17
2
21
20
19
22
1
4
15
23
8
6
5
3
7
16

PROCESS FOR CONVERTING HYDROCARBONS BY TREATMENT IN A DISTILLATION ZONE COMPRISING EXTRACTING A HYDROCARBON CUT AS A SIDE STREAM, ASSOCIATED WITH A REACTION ZONE, AND ITS USE FOR HYDROGENATING BENZENE

BACKGROUND OF THE INVENTION

The invention relates to a process for converting hydrocarbons. The process of the invention associates a distillation zone with a hydrocarbon conversion reaction zone which is at least partially external to the distillation zone into which an effluent comprising hydrogen is introduced. Thus this process can selectively convert hydrocarbons, separated from a hydrocarbon feed by means of the distillation zone, in an associated reaction zone, withdrawing the feed for the reaction zone from the distillation zone and re-introducing the converted feed into the distillation zone.

More particularly, the process of the invention is applicable to selective reduction of the quantity of light unsaturated compounds (i.e., containing at most six carbon atoms per molecule) comprising optional olefins and benzene, of a hydrocarbon cut essentially comprising at least 5 carbon atoms per molecule, with no substantial loss of octane number.

The general trend now is to reduce the quantity of benzene and olefins (unsaturated compounds) in gasolines, because of their known toxicity.

Benzene has carcinogenic properties and thus the possibility of it polluting the air must be limited as far as possible, in particular by practically excluding it from automobile fuels. In the United States, reformulated fuels must not contain more than 1% by volume of benzene; in Europe, it has been recommended that a gradual decrease towards that value be made.

Olefins are acknowledged as being among the most reactive hydrocarbons in the photochemical cycle of reactions with oxides of nitrogen, which occur in the atmosphere and which leads to ozone formation. A rise in the ozone concentration in the air may be a cause of respiratory problems. A reduction in the olefin content in a gasoline, more particularly of the lightest olefins which have a greater tendency to evaporate when manipulating the fuel, is thus desirable.

The benzene content of a gasoline is very largely dependent on that of the reformate component in that gasoline. The reformate results from catalytic treatment of naphtha intended to produce aromatic hydrocarbons, principally comprising 6 to 9 carbon atoms per molecule and the octane number of which is very high endowing the gasoline with antiknock properties.

Because of the toxicity described above, the amount of benzene in the reformate must be reduced by a maximum.

The benzene in a reformate can be hydrogenated to cyclohexane. Since it is impossible to selectively hydrogenate benzene in a mixture of hydrocarbons also containing toluene and xylenes, that mixture must first be fractionated to isolate a cut containing only benzene, which can then be hydrogenated.

International patent application WO 95/15934 describes a reactive distillation which aims to selectively hydrogenate diolefins and C2–C5 acetylenic compounds. The catalytic hydrogenation zone is completely internal to the distillation column, which means that the hydrogen cannot dissolve properly in the feed and the pressure cannot be increased.

A number of processes have been described in which the catalytic benzene hydrogenation zone is internal to the distillation column which separates benzene from other aromatic compounds, which cuts the cost of the apparatus. Such processes are described in United States patents U.S. Pat. Nos. 4,232,177, 4,307,254, 4,336,407, 3,629,478, 4,471,154 and 3,629,478. It appears that the pressure drop across the catalytic bed(s) in that process means that an intimate mixture between the liquid phase and the gaseous stream containing the hydrogen cannot be obtained. In that type of technology where the reaction and distillation proceed simultaneously in the same physical space, the liquid phase descends through every catalytic bed in the reaction zone in a trickle flow, and thus in threads of liquid. The gaseous fraction containing the fraction of vaporised feed and the gas stream containing hydrogen rise through the catalytic bed in columns of gas. In that arrangement, the entropy of the system is high and the pressure drop across the catalytic bed(s) is low. As a result, operating that type of technique cannot easily promote dissolution of hydrogen in the liquid phase comprising the unsaturated compound(s).

A number of processes have been described in which the reaction zone is external to the distillation column with the feed to be converted being withdrawn at one level of the column and the converted effluent being re-introduced into the column. Such processes are described in U.S. Pat. No. 4,503,265 and in International applications WO 93/19031, WO 93/19032 and WO 94/13599 for application to the synthesis of alkylethers. Similarly, U.S. Pat. No. 5,177,283 describes this technique for alkylating aromatic hydrocarbons.

The Applicant's European patent application EP-A1-0 781 830 describes a process for hydrogenating benzene using a distillation column associated with a reaction zone which is at least partially external. The feed for the reaction zone is withdrawn from the distillation zone then the effluent from the reaction zone is re-introduced into the distillation zone. A distillate is recovered from the head of the distillation zone and a reformate is recovered from the bottom of the distillation zone.

BRIEF SUMMARY OF THE INVENTION

The process of the present invention is an improvement over the Applicant's patent application EP-A1-0 781 830, the features of which are hereby included in the present description.

The invention provides a process for converting a hydrocarbon feed associating a distillation zone producing an overhead distillate and a bottom effluent and a reaction zone which is at least partially external to the distillation zone. At least one reaction for converting at least a portion of at least one hydrocarbon takes place in a reaction zone comprising at least one catalytic bed, in the presence of a catalyst and of a gas stream comprising hydrogen. The feed for the reaction zone is drawn off from the distillation zone at the height of a draw-off level and represents at least a portion of the liquid flowing in the distillation zone, and at least a portion of the effluent from the reaction zone is re-introduced into the distillation zone at the height of at least one re-introduction level, so as to ensure continuity of distillation. The invention is characterized in that at least one liquid effluent is also withdrawn from the distillation zone at the height of at least one withdrawal level, at least a portion of said liquid effluent being at least partially treated in a gas-liquid side separation zone (splitter) wherein at least part of the gaseous effluent is re-introduced into the distillation zone and wherein at least part of the liquid effluent is recovered as an intermediate cut.

Thus the process of the present invention can recover at least one hydrocarbon cut at an intermediate level in the distillation zone, i.e., at a level between the bottom and the head of the distillation zone, with quantities of the desired products which can be adjusted as required, said cut being free of the major portion of the lightest compounds at least part of which are re-introduced into the distillation zone after separation in the gas-liquid side separation zone. The association of a distillation zone and a reaction zone means that the process of the invention enables products to be to separated using the distillation zone and to specifically convert certain compounds, under advantageous temperature and pressure conditions, in order to recover a distillate from the head of the distillation zone in which the major portion of the hydrocarbons to be converted has been converted and to recover at least a fraction of the intermediate hydrocarbons with the desired hydrocarbon composition from the conversion reaction, of hydrocarbons present in the feed from the distillation zone and of other compounds introduced for the conversion reaction, from any point of the distillation zone.

BRIEF DESCRIPTION OF THE DRAWINGS

FIG. 1 illustrates an implementation of the process of invention.

DETAILED DESCRIPTION OF THE INVENTION

The particular application of the process of the invention to a process for reducing the benzene content in a hydrocarbon feed enables a reformate which is depleted in benzene or, if necessary, which is almost completely free of benzene and other unsaturated hydrocarbons containing at most six carbon atoms per molecule such as light olefins and at least one reformate comprising the desired quantity of benzene and other unsaturated hydrocarbons to be produced from a crude reformate, with no significant loss in yield, while limiting hydrogenation of the $C_7^+$ compounds (i.e., containing at least seven carbon atoms per molecule).

The process of the invention applied to the hydrogenation of benzene is, for example, a process for treating a feed, the major portion of which is constituted by hydrocarbons containing at least 5, preferably 5 to 9, carbon atoms per molecule, and comprising at least one unsaturated compound, comprising benzene and possibly olefins in which said feed is treated in a distillation zone associated with a hydrogenation reaction zone which is at least partially external and comprises at least one catalytic bed, in which hydrogenation of at least a portion of the unsaturated compounds contained in the feed, containing at most six carbon atoms per molecule, i.e., containing up to six (inclusive) carbon atoms per molecule, is carried out in the presence of a hydrogenation catalyst and a gas stream comprising hydrogen, preferably in the major portion, the feed for the reaction zone being drawn off from the height of a draw-off level and representing at least a portion, preferably the major portion, of the liquid flowing in the distillation zone, at least a portion, preferably the major portion, of the effluent from the reaction zone being re-introduced into the distillation zone at a height of at least one re-introduction level, so as to ensure continuity of distillation, said process being characterized in that at least one liquid effluent is also withdrawn from the distillation zone at the height of at least one withdrawal level, at least a portion of said liquid effluent being at least partially treated in a gas-liquid side separation zone (splitter), wherein at least a portion of the gaseous effluent is re-introduced into the distillation zone and wherein at least a portion of the liquid effluent is recovered as an intermediate cut.

The process of the invention enables an intermediate cut to be extracted containing about the desired quantity of benzene and light olefins for the unsaturated compounds. As an example, the process of the invention, in one of its implementations, can directly recover a naphtha cut, i.e., a light hydrocarbon cut, the major portion of which comprises hydrocarbons containing 5 to 11 carbon atoms per molecule, and reduced in benzene. In that example, the intermediate cut recovered is free of the major portion of the light hydrocarbons containing up to 4 carbon atoms and at least a portion of the hydrocarbons containing 5 carbon atoms per molecule.

Thus in the case of the application of the process of the invention to the reduction of the benzene content of a reformate, the invention enables a usable cut to be directly recovered, comprising about the quantity of benzene necessary, and freed of its lightest constituents, while avoiding a loss of these light constituents, by recycling those compounds to the distillation zone.

Thus the process of the invention comprises withdrawing at least one liquid effluent from the distillation zone to at least one gas-liquid side separation zone from which emanates an intermediate liquid cut and a gaseous effluent at least part of which is recycled to the distillation zone.

The liquid effluent to be separated can be withdrawn from at least one withdrawal level. The withdrawal level for the liquid effluent to be separated is generally located above the level at which the feed is introduced into the distillation zone and can be any level between the level at which the feed is introduced into the distillation zone and the distillation head zone. Said withdrawal level can be located above or below the level at which the feed for the reaction zone is withdrawn, and above or below the level at which the effluent from the reaction zone is re-introduced into the distillation zone.

The recycle level for the gaseous fraction from the side separation zone is generally above the level at which the feed is introduced into the distillation zone. Said recycle level is generally located above the level at which the liquid distillate is withdrawn to the side separation zone. Said recycle level can be located above or below the withdrawal level for the feed for the reaction zone, or above or below the level at which the effluent from the reaction zone is re-introduced into the distillation zone.

Preferably, the process of the invention comprises one level for withdrawing liquid effluent to the gas-liquid side separation zone.

In addition to recovering an intermediate cut withdrawn from any level in the distillation zone, the process of the invention comprises recovering an overhead distillate in which the major portion of the hydrocarbons has been converted by means of the reaction zone associated with the distillation zone, said distillate thus containing a minor portion of the compounds to be converted in the reaction zone. This overhead distillate can be recovered in the form of a vapour distillate, at least a portion of the vapour distillate being condensed then recycled to the distillation zone to ensure reflux.

In a preferred implementation of the process of the invention, the process comprises a stabilisation zone. In this case, a stabilised liquid distillate is withdrawn from the distillation zone from a draw-off level located below the draw-off level for the distillate at the head of the distillation zone. Thus the desired product is recovered as a stabilised liquid distillate, i.e., free of the major portion of the excess hydrogen and at least a portion of the light gases which are recovered in the vapour distillate. This distinct recovery of liquid distillate eliminates via the gaseous distillate gases other than hydrogen present in the gaseous stream comprising hydrogen as its major portion introduced into the reaction zone to carry out the conversion reaction.

This preferred implementation enables a number of distillates to be recovered: at least one stabilised distillate and at least one intermediate cut. In general, the stabilised distillate is withdrawn from a level located above the level from which the intermediate cut is withdrawn.

Thus, for example, this preferred implementation, in its particular application to benzene hydrogenation, enables a stabilised liquid distillate to be recovered directly by withdrawal from the distillation zone, in which benzene and any unsaturated compound containing at most 6 carbon atoms per molecule and other than benzene which may be present in the feed has been at least partially selectively hydrogenated, while limiting the hydrogenation of $C_7^+$ compounds (i.e., containing at least seven carbon atoms per molecule).

When hydrogenating benzene, the stabilised liquid distillate essentially contains liquid compounds containing at least 5 carbon atoms per molecule and which can be directly used as fuels.

The distillation zone generally comprises at least one column provided with at least one distillation contact means selected from the group formed by plates, bulk packing and structured packing, as is well known to the skilled person, such that the total global efficiency is equal to at least five theoretical plates. In cases known to the skilled person where using a single column can cause problems, it is preferable to split the zone and use two columns which, placed end to end, produce said zone.

The feed is introduced into the distillation zone at least one introduction level located below the level for drawing off liquid towards the reaction zone, generally at a level of 2 to 40 theoretical plates and preferably 2 to 20 theoretical plates below the level for drawing off liquid towards the reaction zone, the draw-off level under consideration being the lowest.

The reaction zone generally comprises at least one catalytic bed, preferably 1 to 4 catalytic bed(s); when at least two catalytic beds are incorporated into the distillation zone, these two beds may be separated by at least one distillation contact means.

In the particular application of the process of the invention to the selective reduction of the amount of light unsaturated compounds comprising benzene and possibly olefins from a hydrocarbon cut, the reaction zone is a hydrogenation zone. In this case, the hydrogenation reaction zone carries out at least partial hydrogenation of benzene present in the feed, generally such that the benzene content in the stabilised liquid distillate extracted below the head distillate withdrawal level is a maximum of a certain value, and said reaction zone hydrogenates at least part, preferably the major part, of any unsaturated compound containing at most six carbon atoms per molecule and other than benzene, which may be present in the feed.

The reaction zone is at least partially external to the distillation zone. Generally, the process of the invention includes 1 to 6, preferably 1 to 4 draw-off level(s) which supply the external portion of the zone. A portion of the external portion of the reaction zone which is supplied by a given draw-off level, if the external portion of the reaction zone comprises at least two draw-off levels, generally comprises at least one reactor, preferably a single reactor.

The level for re-introducing the feed which has been at least partially converted in the external reaction zone is generally located substantially below or substantially above or substantially at the same height of at least one draw-off level, preferably said level for drawing off feed from the distillation zone. Preferably, the re-introduction level is located above the draw-off level.

Since the reactor is at least partially external, a flow of liquid is drawn off which is equal to, greater than or less than the liquid traffic in the distillation zone located below the draw-off level for the feed to be converted.

In the particular application of converting a feed from a distillation zone with a rather high benzene content, for example over 3% by volume, the flow rate of liquid drawn off is preferably equal to or greater than the liquid traffic in the distillation zone located below the draw-off level.

In the particular application of converting feeds with a rather low benzene content, for example less than 3% by volume, the flow rate of liquid drawn off is preferably equal to or less than the liquid traffic in the distillation zone located below the withdrawal level.

The process of the invention can convert a large portion of the compound(s) to be converted external to the distillation zone, possibly under pressure and/or temperature conditions which are different from those used in the distillation zone.

The process of the invention is such that the flow of liquid to be converted is generally co-current to the flow of the gas stream comprising hydrogen for all catalytic beds in the external portion of the reaction zone.

In a preferred implementation of the process of the invention, the reaction zone is completely external to the distillation zone. When the external portion of the reaction zone comprises at least two catalytic beds, each catalytic bed is supplied by a single draw-off level, preferably associated with a single re-introduction level, said draw-off level being distinct from the draw-off level which supplies the other catalytic bed(s).

In a preferred implementation of the process of the invention, the feed to be converted drawn off from the distillation zone towards the reaction zone is cooled before it enters the reactor. The converted feed leaving the reactor can be cooled before re-introducing it into the distillation zone. This cooling creates a circulating reflux. In fact, in the context of the present description, the term <<circulating reflux>> means a circulation of a liquid drawn off from the distillation zone at one level and re-introduced to a higher level at a temperature which is lower than the temperature of the liquid at the draw-off level.

In the particular case of reducing the benzene content in a hydrocarbon cut, one preferred implementation of the invention is such that the level of re-introducing the hydrogenated feed into the column is located above the level for drawing off the feed to be hydrogenated, in a zone where the benzene content is the lowest. More preferably, the re-introduction level is located at least 2 theoretical plates above the draw-off level and more preferably still, the level for re-introducing the feed is located at least 4 theoretical plates above the draw-off level for said feed.

In order to carry out hydrogenation using a particular application of the process of the invention, the theoretical mole ratio of hydrogen necessary for the desired conversion of benzene is 3. The quantity of hydrogen distributed upstream of or in the hydrogenation zone is optionally in excess with respect to this stoichiometry, and this must be higher when, in addition to the benzene in the feed, any unsaturated compound containing at most six carbon atoms per molecule present in said feed must be at least partially hydrogenated.

In general, the excess hydrogen, if any, can advantageously be recovered for example using one of the techniques described below. In a first technique, the excess hydrogen leaving the reaction zone is recovered either directly at the level of the effluent at the outlet from the reaction zone, or in the gaseous distillate from the distillation zone, then compressed and re-used in said reaction zone to create a reflux. In a second technique, the excess hydrogen which leaves the reaction zone is recovered, then injected upstream of the compression steps associated with a catalytic reforming unit, mixed with hydrogen from said unit, said unit preferably operating at low pressure, i.e., generally at an absolute pressure of less than 0.8 MPa.

The hydrogen included in the gas stream, used, for example, in the particular process of the invention for hydrogenating unsaturated compounds containing at most six carbon atoms per molecule, can originate from any source producing at least 50% by volume pure hydrogen, preferably at least 80% by volume pure hydrogen and more preferably at least 90% pure hydrogen. As an example, the hydrogen from catalytic reforming processes, methanation, PSA (pressure swing adsorption), electrochemical generation or steam cracking can be cited.

One preferred implementation of the process of the invention, which may or may not be independent of the preceding implementations, is such that the effluent from the bottom of the distillation zone is at least partially mixed with the stabilised liquid distillate recovered from a recovery level located below the vapour distillate recovery level. In the particular case when reducing the benzene content, the mixture obtained can be used as a fuel either directly, or by incorporation into fuel fractions.

When the reaction zone is partially internal to the distillation zone, the operating conditions for the portion of the reaction zone internal to the distillation zone are linked to the operating conditions for the distillation step. Distillation is carried out at an absolute pressure which is generally in the range 0.1 MPa to 2.5 MPa with a reflux ratio in the range 0.1 to 20. The temperature in the distillation zone is in the range 10° C. to 300° C. In general, the liquid to be converted is mixed with a gas stream comprising hydrogen the flow rate of which is equal to at least the stoichiometry of the conversion reactions carried out and is at most equal to the flow rate corresponding to 10 times the stoichiometry. In the external portion of the reaction zone, the catalyst is located in every catalytic bed using any technology which is known to the skilled person under operating conditions (temperature, pressure, . . . ) which may or may not be independent, preferably independent, of the operating conditions of the distillation zone. In the portion of the reaction zone external to the distillation zone, the operating conditions are generally as follows. The absolute pressure required is generally in the range 0.1 to 6 MPa. The operating temperature is generally in the range 30° C. to 400° C. The space velocity in said reaction zone, calculated with respect to the catalyst, is generally in the range 0.5 to 60 $h^{-1}$. The flow rate of hydrogen corresponding to the stoichiometry of the conversion reactions carried out is in the range 1 to 10 times said stoichiometry.

In the particular case of hydrogenating benzene and other unsaturated compounds, the operating conditions are as follows. When the hydrogenation zone is partially internal to the distillation zone, the operating conditions for the portion of the hydrogenation zone internal to the distillation zone are linked to the operating conditions for the distillation step. Distillation is carried out at an absolute pressure generally in the range 0.2 to 2 MPa, preferably in the range 0.4 to 1 MPa, with a reflux ratio in the range 0.1 to 10, preferably in the range 0.2 to 1. The temperature at the head of the zone is generally in the range 30° C. to 180° C. and the temperature at the bottom of the zone is generally in the range 120° C. to 280° C. The hydrogenation reaction is carried out under conditions which are most generally intermediate between those established at the head and at the bottom of the distillation zone, at a temperature in the range 100° C. to 200° C., preferably in the range 120° C. to 180° C., and at an absolute pressure in the range 0.2 to 3 MPa, preferably in the range 0.4 to 2 MPa. The liquid undergoing hydrogenation is mixed with a gas stream comprising hydrogen the flow rate of which depends on the concentration of benzene in said liquid and, more generally, on the concentration of the unsaturated compounds containing at most six carbon atoms per molecule in the feed from the distillation zone. The hydrogen flow rate is generally equal to at least the flow rate corresponding to the stoichiometry of the hydrogenation reactions carried out (hydrogenation of benzene and other unsaturated compounds containing at most six carbon atoms per molecule, in the hydrogenation feed) and at most equal to the flow rate corresponding to 10 times the stoichiometry, preferably in the range 1 to 6 times the stoichiometry, more preferably in the range 1 to 3 times the stoichiometry. In the portion of the hydrogenation zone external to the distillation zone, the operating conditions are generally as follows. The absolute pressure required for this hydrogenation step is generally in the range 0.1 to 6 MPa absolute, preferably in the range 0.2 to 5 MPa and more preferably in the range 0.5 to 3.5 MPa. The operating temperature in the hydrogenation zone is generally in the range 100° C. to 400° C., preferably in the range 120° C. to 350° C. and more preferably in the range 140° C. to 320° C. The space velocity in said hydrogenation zone, calculated with respect to the catalyst, is generally in the range 1 to 60 and more particularly in the range 1 to 40 $h^{-1}$ (volume flow rate of feed per volume of catalyst). The hydrogen flow rate corresponding to the stoichiometry of the hydrogenation reactions carried out is in the range 1 to 10 times said stoichiometry, preferably in the range 1 to 6 times said stoichiometry and more preferably in the range 1 to 3 times said stoichiometry. However, the temperature and pressure conditions can also be comprised between those which are established at the head and at the bottom of the distillation zone in the process of the present invention.

In the context of the present description, the term <<reflux ratio)>> means the ratio of the mass flow rate of the reflux over the mass flow rate of the supply to the column.

In the particular case when the reaction zone is a zone for hydrogenating benzene and possible olefins, the catalyst used in the hydrogenation zone generally comprises at least one metal selected from group VIII, preferably selected from the group formed by nickel and platinum, used as it is or, preferably, deposited on a support. At least 50% of the metal must generally be in its reduced form. However, any other hydrogenation catalyst which is known to the skilled person can also be used.

When using nickel, the proportion of nickel with respect to the total catalyst weight is in the range 5% to 70%, more particularly in the range 10% to 70%, and preferably in the range 15% to 65%. Further, the average nickel crystallite size in the catalyst is less than $100\times10^{-10}$ m, preferably less than $80\times10^{-10}$ m, more preferably less than $60\times10^{-10}$ m.

The support is generally selected from the group formed by alumina, silica-aluminas, silica, zeolites, activated charcoal, clays, aluminous cements, rare earth oxides and alkaline-earth oxides, used alone or as a mixture. Preferably, a support based on alumina or silica is used, with a specific surface area in the range 30 to 300 $m^2/g$, preferably in the range 90 to 260 $m^2/g$.

The hydrocarbon feed is sent to a column 2 via a line 1. Said column contains distillation contact means, which in the case shown in FIG. 1 are plates or packing, partially represented by dotted lines in the FIGURE.

At the foot of the column, the least volatile fraction of the reformate is recovered via a line 5, a portion is reboiled in exchanger 6 and a portion is evacuated via a line 7. The reboiling vapour is re-introduced into the column via a line 8. The stabilised liquid distillate is extracted via a line 18, the vapour distillate is sent via a line 9 to a condenser 10 then to a drum 11 from which the liquid distillate is extracted via a line 14. A portion of the liquid phase from drum 11 is returned via a line 12 to the head of the column as a reflux, and a further portion of the liquid phase is recovered via a line 13.

A liquid is drawn off via a line 15 by means of a draw-off plate located in the distillation zone, and the liquid is sent to the head of a reactor 3, after adding hydrogen via a line 4. The effluent from the reactor is cooled in an exchanger 16 then recycled to the column via a line 17.

The liquid effluent to be separated is withdrawn from the distillation zone via a line 19, then sent to a gas-liquid side separation zone (20), from which the gaseous effluent is recycled to the distillation zone via line 21 and an intermediate cut is recovered via a line 23. A portion of the cut is reboiled in exchanger 22.

EXAMPLE (IN ACCORDANCE WITH THE INVENTION)

The following Example illustrates a particular application of the invention, i.e., selective reduction of unsaturated compounds and benzene in a hydrocarbon cut. They were carried out by simulation using PRO/II® software from Simulation Sciences Incorporated.

The process configuration involves withdrawal of a liquid effluent to a gas-liquid side separation zone, with re-introduction of the gaseous effluent into the distillation zone and recovery of a liquid effluent as an intermediate cut. The unit is shown in FIG. 1.

The process configuration involves withdrawal of a stabilised liquid effluent below the withdrawal of a vapour distillate and with a hydrogenated feed re-introduction level 9 plates above the withdrawal plate.

The column comprised 57 theoretical plates (including condenser and reboiler) and had a diameter of 3.35 m. The associated splitter had 7 theoretical plates (including the reboiler).

The reflux ratio with respect to the supply (by weight) was 1.02. The reboiler power was 12800 kW. The splitter reboiler power was 271 kW.

The process was carried out with an external hydrogenation reactor containing 7 $m^3$ of catalyst and operating at an absolute pressure of 1.5 MPa. The nickel catalyst is sold by PROCATALYSE under reference LD746.

The stabilised liquid effluent (light reformate) was recovered from plate 3 via line 18 and the vapour distillate was recovered from the column head via line 14. The feed was injected into plate 37 of the column via line 1. The feed for reactor 3 was withdrawn from plate 30 via line 15. Hydrogen was introduced via line 4 before entering the reactor, which operated in downflow mode and at 1.5 MPa absolute pressure. The hydrogen/benzene mole ratio was 2.63. the effluent from reactor 3 was cooled then re-injected into the column via line 17 at plate 21. The absolute pressure in the reflux drum was 0.75 Pa.

The simulated compositions of the stabilised liquid fraction (light reformate) (18), purge vapour (14), heavy reformate (7) and intermediate cut (23) fractions are shown in Table 1.

It can be seen that the process of the present invention, where a treated liquid distillate is withdrawn into a splitter, enables a directly usable intermediate cut to be recovered. In this particular example, the intermediate cut is a naphtha cut comprising about 3.8% by volume of benzene.

The light reformate (18) contained 0.35% by volume of benzene; the heavy reformate (7) contained 0.6% by volume of benzene. The REID vapour tension of the naphtha was 0.086 MPa, and that of the mixture constituted by the light reformate and the heavy reformate was 0.022 MPa.

TABLE 1

Composition of feed and effluents for Example 1 (gas-liquid side separation zone)

| Substance/ kmoles/h | Feed | $H_2$ | Gas purge (14) | Light reformate (18) | Naphtha withdrawal (23) | Heavy reformate (7) |
|---|---|---|---|---|---|---|
| $H_2$ | 0.00 | 183.13 | 5.03 | 0.00 | 0.00 | 0.00 |
| Methane | 0.00 | 31.85 | 31.84 | 0.02 | 0.00 | 0.00 |
| Ethane | 0.00 | 15.63 | 15.55 | 0.08 | 0.00 | 0.00 |
| Propane | 0.00 | 6.64 | 6.20 | 0.45 | 0.00 | 0.00 |
| Butanes | 13.63 | 0.84 | 8.40 | 5.85 | 0.21 | 0.00 |
| Iso-pentanes | 60.80 | 0.25 | 5.96 | 52.40 | 2.70 | 0.00 |
| Normal pentanes | 43.33 | 0.11 | 2.49 | 38.81 | 2.60 | 0.00 |
| Dimethylbutanes | 15.88 | | 0.14 | 11.04 | 4.71 | 0.00 |
| Other C6 paraffins | 62.87 | | 0.16 | 23.59 | 39.13 | 0.00 |
| Hexane | 31.92 | | 0.00 | 1.19 | 33.52 | 0.01 |
| C7 paraffins | 53.60 | | 0.00 | 0.00 | 20.70 | 33.20 |
| C8 paraffins | 6.93 | | 0.00 | 0.00 | 0.01 | 6.93 |
| C9 + paraffins | 2.96 | | 0.00 | 0.00 | 0.00 | 2.96 |

TABLE 1-continued

Composition of feed and effluents for Example 1 (gas-liquid side separation zone)

| Substance/ kmoles/h | Feed | $H_2$ | Gas purge (14) | Light reformate (18) | Naphtha withdrawal (23) | Heavy reformate (7) |
|---|---|---|---|---|---|---|
| Cyclopentane | 2.74 | | 0.05 | 2.34 | 0.35 | 0.00 |
| Methylcyclopentane | 4.47 | | 0.00 | 0.03 | 4.39 | 0.04 |
| Cyclohexane | 0.45 | | 0.00 | 0.01 | 44.87 | 9.02 |
| Methylcyclohexane | 3.67 | | 0.00 | 0.00 | 1.47 | 6.92 |
| C8 naphthenes | 0.50 | | 0.00 | 0.00 | 0.00 | 0.50 |
| Pentenes | 1.17 | | 0.07 | 0.58 | 0.05 | 0.00 |
| Hexenes | 2.99 | | 0.00 | 0.01 | 0.17 | 0.00 |
| Heptenes | 1.50 | | 0.00 | 0.00 | 0.03 | 1.16 |
| Benzene | 69.45 | | 0.00 | 0.65 | 8.58 | 6.77 |
| Toluene | 286.45 | | 0.00 | 0.00 | 0.31 | 281.53 |
| C8 aromatics | 307.41 | | 0.00 | 0.00 | 0.03 | 307.38 |
| C9 + aromatics | 165.13 | | 0.00 | 0.00 | 0.00 | 165.13 |
| TOTAL | 1137.96 | 238.46 | 75.87 | 137.05 | 163.84 | 821.55 |

What is claimed is:

1. A process for converting a hydrocarbon feed in which said feed is treated in a distillation zone producing an overhead distillate and a bottom effluent, associated with a reaction zone which is at least partially external, comprising at least one catalytic bed in which at least one conversion reaction of at least a portion of at least one hydrocarbon is carried out in the presence of a catalyst and a gas stream comprising hydrogen, the feed for the reaction zone being drawn off from the distillation zone at the height of at least one draw-off level and representing at least a portion of the liquid flowing in the distillation zone, at least a portion of effluent from the reaction zone being re-introduced into the distillation zone at the height of at least one re-introduction level, so as to ensure continuity of distillation, said process being characterized in that at least one liquid effluent is withdrawn from the distillation zone at the height of at least one withdrawal level, at least a portion of said liquid effluent being at least partially treated in a gas-liquid side separation zone (splitter) wherein at least part of the splitter gaseous effluent is re-introduced into the distillation zone and wherein at least part of the splitter liquid effluent is recovered as an intermediate cut, and a stabilised liquid effluent is also withdrawn as a second sidestream from a draw-off level located below the upper distillate level, said stabilised liquid effluent being either at least partially recovered as a product or at least partially mixed with the bottom effluent.

2. A process according to claim 1, comprising a single level for withdrawing liquid effluent to the gas-liquid side separation zone.

3. A process according to claim 1, comprising a single level for withdrawing feed for the reaction zone.

4. A process according to claim 1, in which the level for re-introducing effluent from the reaction zone is located above the level for withdrawing feed for the reaction zone.

5. A process according to claim 4, in which the level for re-introducing effluent from the reaction zone is at least the second theoretical plate above the level for withdrawing feed for the reaction zone.

6. A process according to claim 1, in which the reaction zone is completely external to the distillation zone.

7. A process according to claim 1, in which distillation is carried out at an absolute pressure in the range 0.1 to 2.5 MPa with a reflux ratio in the range 0.1 to 20 and at a temperature in the range 10° C. to 300° C.

8. A process according to claim 1 in which, for the portion of the conversion reaction which is external to the distillation zone, the absolute pressure is in the range 0.1 to 6 MPa, the temperature is in the range 30° C. to 400° C., the space velocity in the conversion zone, calculated with respect to the catalyst, is in the range 0.5 to 60 $h^{-1}$ (volume of feed per volume of catalyst per hour), and the hydrogen flow rate is in the range one to ten times the flow rate corresponding to the stoichiometry of the conversion reactions occurring.

9. A process according to claim 1, in which the major portion of the treated feed is constituted by hydrocarbons comprising at least 5 carbon atoms per molecule and comprising at least one unsaturated compound comprising at least one optional olefin and benzene.

10. A process according to claim 9, in which the reaction zone is a hydrogenation zone, in which hydrogenation of at least a portion of the unsaturated compounds comprising at most six carbon atoms per molecule and contained in the feed is carried out in the presence of a hydrogenation catalyst.

11. A process according to claim 9, in which the liquid effluent from the gas-liquid side separation zone represents an intermediate cut comprising less than 5% by weight of benzene.

12. A process according to claim 9, in which distillation is carried out at an absolute pressure in the range 0.2 to 2 MPa, with a reflux ratio in the range 0.1 to 10, the overhead temperature in the distillation zone being in the range 30° C. to 180° C. and the bottom temperature of the distillation zone being in the range 120° C. to 280° C.

13. A process according to claim 9 in which, for the portion of the hydrogenation reaction occurring external to the distillation acid, the absolute pressure is in the range 0.1 to 6 MPa, the temperature is in the range 100° C. to 400° C., the space velocity in the hydrogenation zone, calculated with respect to the catalyst, is in the range 1 to 60 $h^{-1}$ (volume of feed per volume of catalyst per hour) and the hydrogen flow rate is in the range one to ten times the flow rate corresponding to the stoichiometry of the hydrogenation reactions taking place.

14. A process according to claim 9 in which, for the portion of the hydrogenation reaction occurring internal to the distillation zone, the hydrogenation reaction is carried out at a temperature in the range 100° C. to 200° C., at an absolute pressure in the range 0.2 to 3 MPa, and with a hydrogen flow rate supplying the hydrogenation zone in the range one to ten times the flow rate corresponding to the stoichiometry of the hydrogenation reactions taking place.

15. A process according to claim 9, in which the catalyst used in the hydrogenation reaction zone comprises nickel or platinum.

16. A process according to claim 1 further comprising at least partially mixing the bottom effluent of the distillation zone with the stabilised liquid effluent withdrawn from a draw-off level located below the vapour distillate level.

17. A process according to claim 1 wherein the reaction zone comprises 2–4 catalytic beds.

18. A process according to claim 1 wherein the reaction zone comprises at least two catalytic beds incorporated into the distillation zone.

19. A process according to claim 1, wherein the draw-off level for the stabilised liquid effluent is above the draw-off level for the at least one liquid effluent which is at least partially treated in the splitter.

* * * * *